US005441206A

United States Patent [19]

Schade et al.

[11] Patent Number: 5,441,206

[45] Date of Patent: Aug. 15, 1995

[54] MOBILE MACHINE FOR PROCESSING RAW MINERAL ORES IN-SITU

[75] Inventors: Jorg Schade, Castrop-Rauxel, Germany; Robert Conraud, Sarreinsming, France

[73] Assignee: Westfalia Becorit Industrietechnik GmbH, Germany

[21] Appl. No.: 273,889

[22] Filed: Jul. 12, 1994

[30] Foreign Application Priority Data

Jul. 14, 1993 [DE] Germany ..... 43 23 492.5

[51] Int. Cl.[6] ..... B02C 21/02; B02C 23/08

[52] U.S. Cl. ..... 241/81; 241/186.35; 241/101.74

[58] Field of Search ..... 241/81, 101.7, 186.35

[56] References Cited

U.S. PATENT DOCUMENTS

| | | | |
|---|---|---|---|
| 3,848,818 | 11/1974 | Vaillant et al. | 241/101.7 |
| 4,215,825 | 8/1980 | Fritz et al. | 241/34 |
| 4,340,185 | 7/1982 | Braun et al. | 241/186.35 |
| 4,655,402 | 4/1987 | Desourdy | 241/76 |
| 4,712,744 | 12/1987 | Kirchhoff et al. | 241/80 |
| 4,763,845 | 8/1988 | Guggenheimer et al. | 241/101.7 |
| 4,881,691 | 11/1989 | Oldengott et al. | 241/101.5 |
| 5,234,564 | 8/1993 | Smith | 209/241 |
| 5,294,065 | 3/1994 | Harms et al. | 241/101.7 |

FOREIGN PATENT DOCUMENTS

| | | |
|---|---|---|
| 1449001 | 9/1976 | United Kingdom . |
| 2203968 | 11/1988 | United Kingdom . |
| WO85/03652 | 8/1985 | WIPO . |

*Primary Examiner*—Irene Cuda
*Assistant Examiner*—John M. Husar
*Attorney, Agent, or Firm*—Samuels, Gauthier & Stevens

[57] ABSTRACT

A mobile machine for use in opencast mining employs a chassis with endless tracks and the chassis has outriggers projecting laterally outwardly from the tracks. A hopper supported by one outrigger receives raw ore material excavated by another machine or machines. The raw ore material passes from the hopper to a screen arrangement with superimposed oscillating screens which sieve the material to separate the finer mineral ore product from the coarser spoil. The mineral ore product which passes through the screens is transferred by a multi-stage conveyor extending perpendicularly to the tracks to a separate conveyor laid on the floor of the working alongside a path of movement of the machine. The spoil is transferred with another conveyor to the inlet of a jib which extends laterally outwardly from the tracks opposite the hopper. The jib itself has a conveyor which transports the spoil along the jib which then discharges the spoil onto a dump.

20 Claims, 4 Drawing Sheets

MOBILE MACHINE FOR PROCESSING RAW MINERAL ORES IN-SITU

FIELD OF THE INVENTION

The present invention relates to a mobile machine usable in opencast mining to process raw mineral ore, such as phosphates, in-situ. More particularly, the invention relates to a machine which processes the raw mineral ore in order to separate and provide a more-refined usable mineral ore product and waste debris or spoil material which is discharged and spread by a jib extending transversely to the direction of movement of the machine.

BACKGROUND OF THE INVENTION

A known machine acting as a mobile breaking or crushing plant is described in DE-2834987. This known machine is designed to reduce the size of lumps of raw coal extracted from an opencast working. The machine receives the raw. Coal from a mechanical shovel and has a crusher which reduces the size of the lumps of raw coal. The reduced coal is then conveyed by a conveyor and is discharged onto a separate conveyor belt.

Other examples of mobile machines which process raw mineral ores are described in DE-3904501 and EP-0327678.

During opencast mining, the crude ore material extracted from the mineral seam or deposit often contains unwanted material, such as rock. In the case of phosphate mining, the raw material contains a considerable proportion of constituents without phosphate or with only a small phosphate content which is not worth recovering aswell as the finer phosphate particles or granules.

A general object of the present invention is to provide a machine usable in opencast mining, particularly but not solely, phosphate mining, which can operate with high efficiency in processing the raw ore material.

SUMMARY OF THE INVENTION

According to the invention there is provided a mobile machine for processing mineral ore in-situ and for discharging spoil after the processing; said machine comprising a hopper for receiving raw mineral ore material excavated from an opencast working, screening means for receiving material from the hopper for separating coarser spoil material from finer mineral ore product, conveyor means for transferring the mineral ore product from the screening means and away from the machine and a jib extending transversely to the normal direction of motion of the machine and equipped with means for transferring the spoil along the jib for discharge.

The jib may extend over a considerable distance and itself employs a conveyor or the like for transferring the spoil or debris along the jib for discharge at its free end. The jib preferably takes an inclined disposition and is pivotably mounted on a chassis of the machine. One or more cables can suspend the jib from a tower or gantry of the machine.

The usable mineral ore separated from the spoil by the screening means is preferably discharged from the conveying means onto a separate conveyor laid on the floor of the working and extending alongside the machine in an intended direction of movement and generally perpendicular to the conveyor means.

The machine constructed in accordance with the invention may receive the raw ore material from another mobile machine, such as a digger or the like, which excavates the raw ore predominately from an end working face of the mineral deposit transverse to the direction of movement. In this way the extraction and processing of the mineral takes place in bands or strips, as known per se, as the machines progress along each side by side band in turn. It is advantageous for the separate ore transporting conveyor, which extends along the length of the bands to remain in position whilst two or more bands are worked. This can be accomplished by making the conveyor means on the machine delivering the usable mineral ore product to be displaceable or adjustable to vary its effective length. The conveyor means can be composed of a fixed conveyor mounted on the chassis of the machine and a further conveyor or conveyor unit which can be assembled to the first-mentioned fixed conveyor to vary the length of the thus-combined conveyor means. The further conveyor or the further conveyor unit can be supported by suspension from the jib and pivotably coupled to the fixed conveyor. In this way, as the distance between the machine and the separate conveyor for transferring the ore product increases when the machine advances from one strip to the next, the conveyor means can be increased in length in a corresponding fashion.

The screening means which separates the spoil and the finer grained ore can be a one or multi-stage oscillating screen.

The spoil is preferably transferred away from the screening means with another intermediate conveyor which can be associated with a crusher to reduce the size of the lumps of spoil and render it better suited for spreading with the jib.

A transfer mechanism, such as a reciprocating pusher, can serve to transfer the raw material from the hopper to the screening means. It is advantageous also to provide a breaking appliance generally above the screening means and the hopper which is adjustable and serves to break up large lumps of raw material passing to the screening means.

The machine can be supported and driven by endless tracks or by wheels carried on the chassis which has outrigger portions extending laterally outwards from the tracks or wheels. One outrigger them supports the hopper and the other supports the jib. The screening means can be supported by the chassis between the hopper and the inlet of the jib.

It is desirable to brace the machine rigidly when the various appliances are operating and the raw ore is being processed in batches. To brace the machine, the chassis can have raisable and lowerable supports, conveniently hydraulically actuated supports, which can engage on the floor of the working to raise partly or relieve the tracks or wheels. Preferably there are three such supports: two supports disposed at or near the hopper on the associated chassis outrigger and a third support on the other chassis outrigger.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
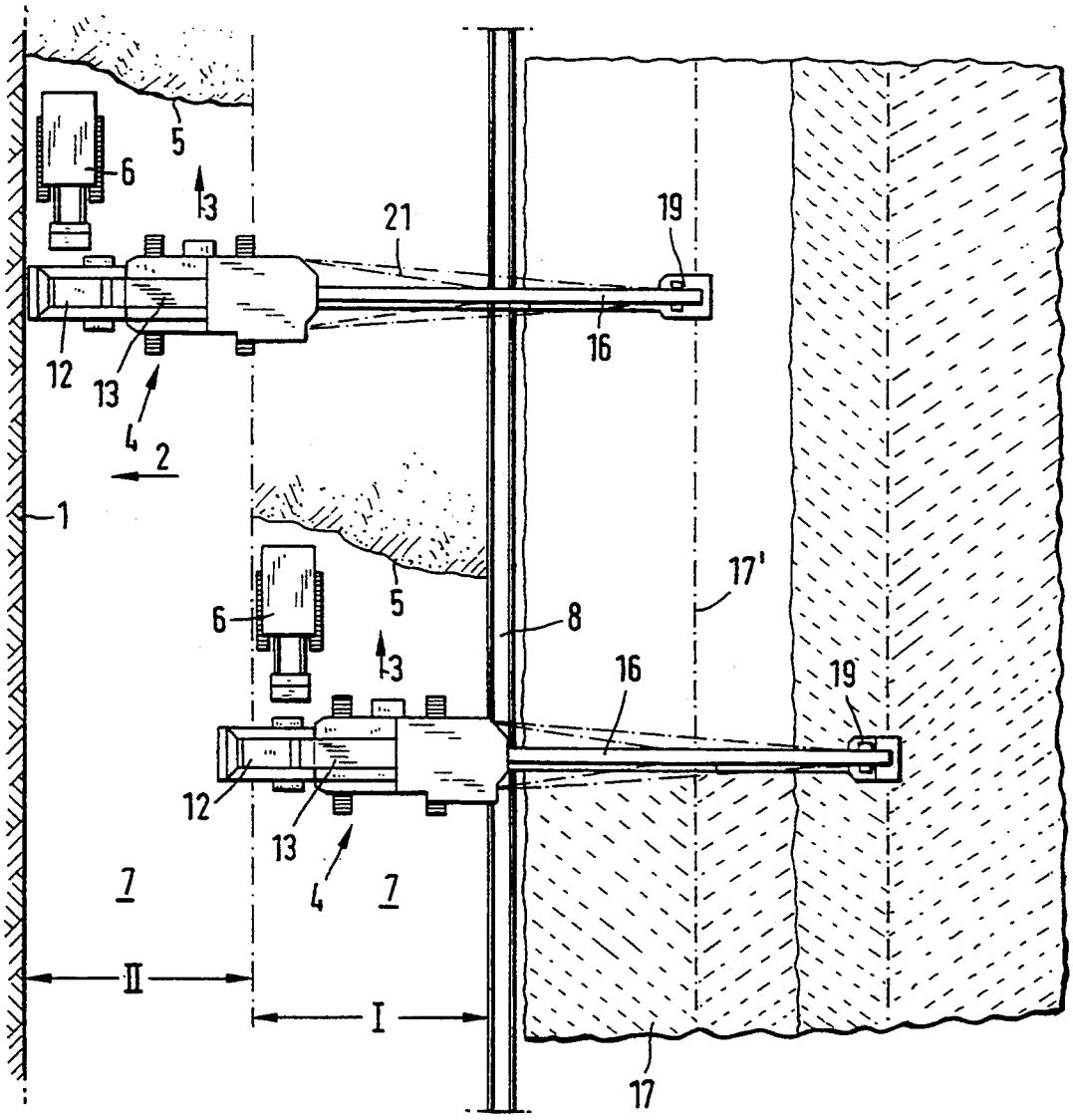
FIG. 1 is a schematic plan view of an opencast mine working with a machine constructed in accordance with the invention in different working positions.
Figure 2:
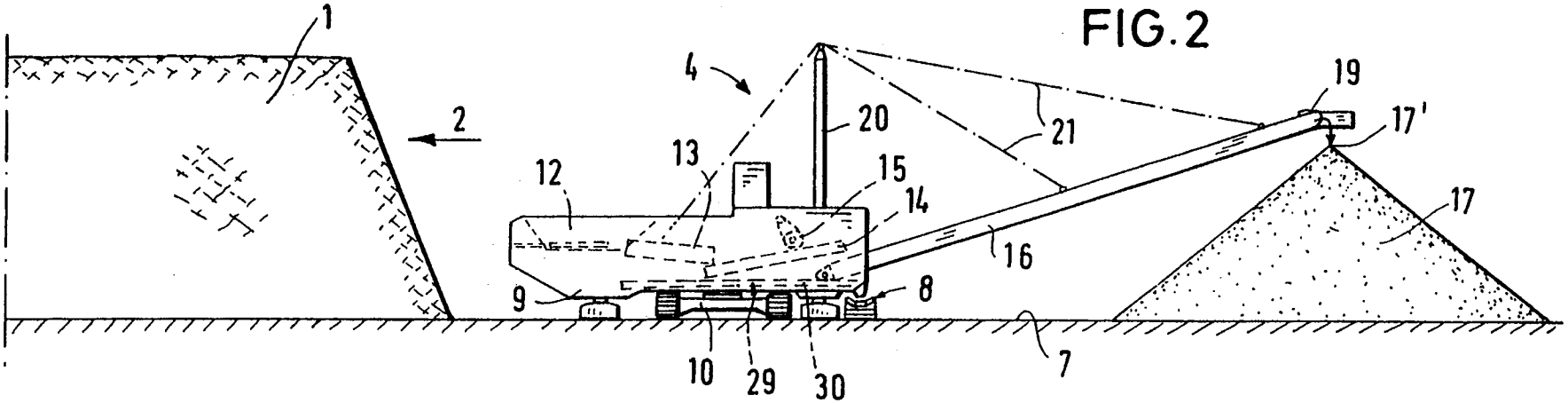
FIGS. 2 and 3 are schematic end views of the machine again depicting the machine in different working positions.
Figure 3:
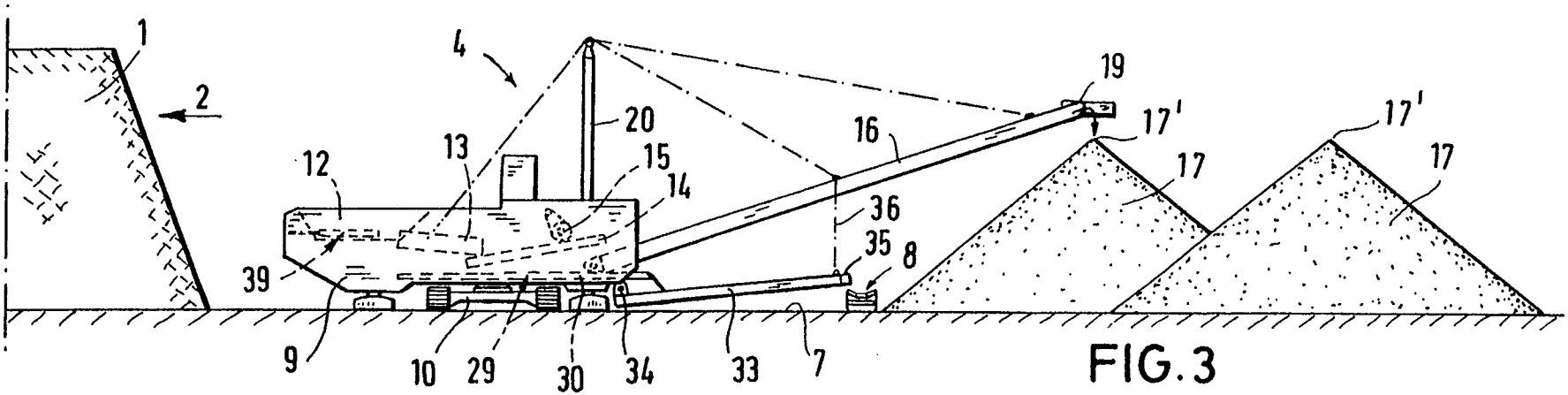

FIGS. 1 to 3 show an opencast mineworking or installation where mineral, such as phosphate, is extracted in strips or bands I, II and processed in situ by a machine 4 constructed in accordance with the invention.

The machine 4 has endless tracks 11 which enables the machine to travel around and in FIGS. 1 to 3 the direction of extraction along one of the bands I,II is designated by reference numeral 3, whilst the direction of progressive advancement from one band I to the next II is designated by reference numeral 2. The machine 4 works in co-operation with a separate extractor machine 6 which is again carried on endless tracks. The machine 6 works the face 5 of the mineral deposit, such as with a cutting appliance or a mechanical shovel in the case of phosphate, as shown in FIG. 1. The excavated raw ore mineral removed progressively by the movement of the machine 6 in the direction 3 is delivered by the machine 6 to the machine 4. FIG. 1 shows the machines 4,6 in the lower representation as progressing along the band I and the machines 4,6, in the upper representation as progressing along the band II. A conveyor 8, conveniently a belt conveyor is laid on the floor 7 of the working parallel to the bands I, II, and at the side of the machine 4 remote from the direction of advancement 2. The conveyor 8 is moved up with the machines 4,6, in the direction 2 as the extraction work progresses from band to band. The machine 4 follows the machine 6 as the extraction advances along each band I, II and is always close enough to the machine 6 to receive the raw mineral ore material extracted from the face 5. The conveyor 8 extends over the entire length of the bands I, II and defines the lateral boundary of each of the bands I,II remote from the advancement direction 2. When the machines 4,6, have progressed along the length of one band the machines 4,6, move back along the now excavated band and are advanced to the next band. The conveyor 8 can remain in place whilst two or more bands I,II are worked.

As shown in FIGS. 1 to 3, the machine 4 has a hopper 12 on the side remote from the conveyor 8 which receives the raw mineral ore material from the machine 6. A screen arrangement 13 fed by the hopper 9 separates out the usable mineral ore product from the raw material. An elongate jib 16 at the opposite side to the hopper 12 discharges the debris or spoil onto a dump 17. The raw mineral ore material excavated by the machine 6 is thus treated in-situ as the machines 4,6 move along each band I, II.

Figure 4:
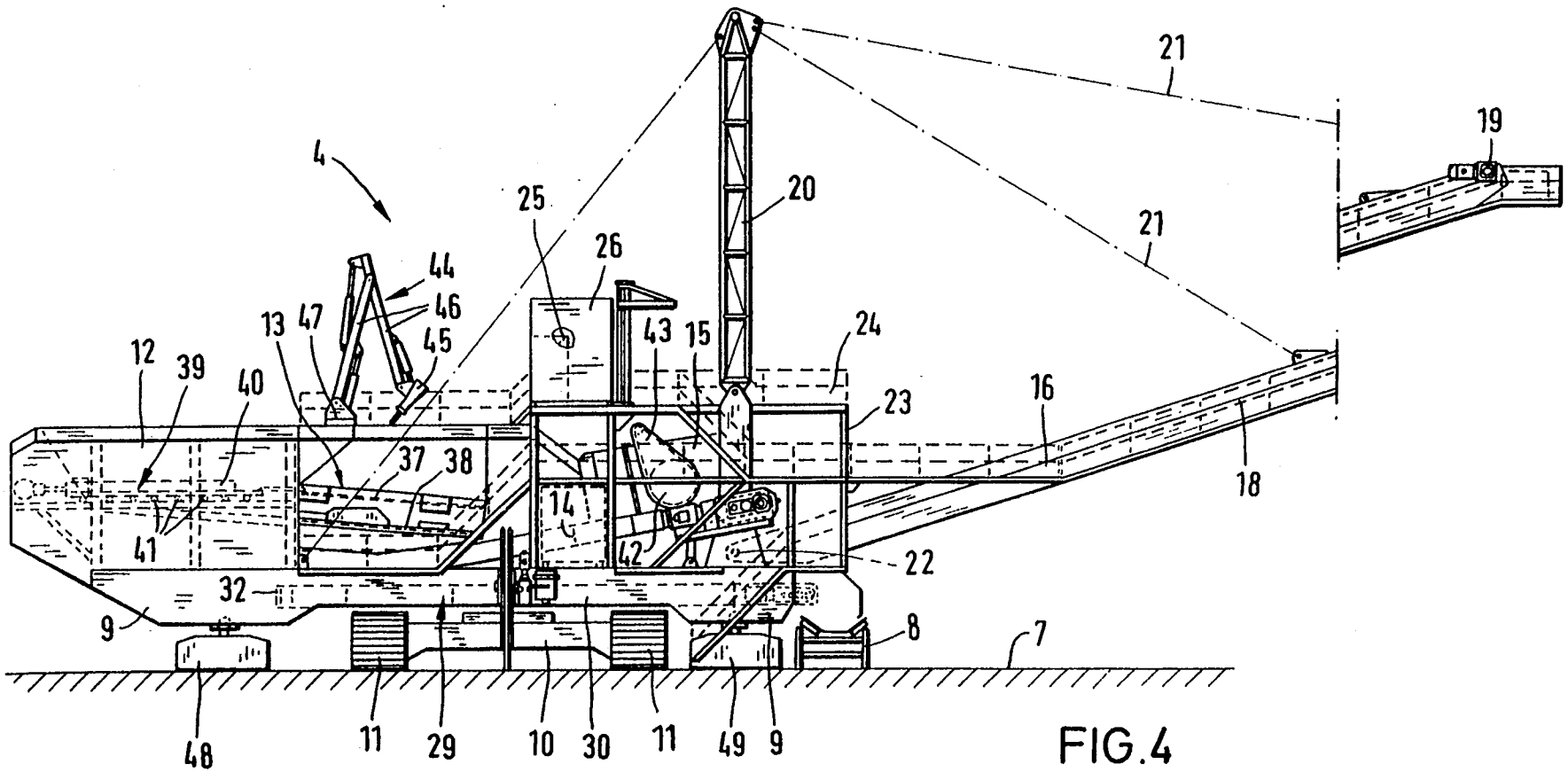
FIG. 4 is a more detailed end view of the machine shown in FIGS. 1 to 3.
Figure 5:
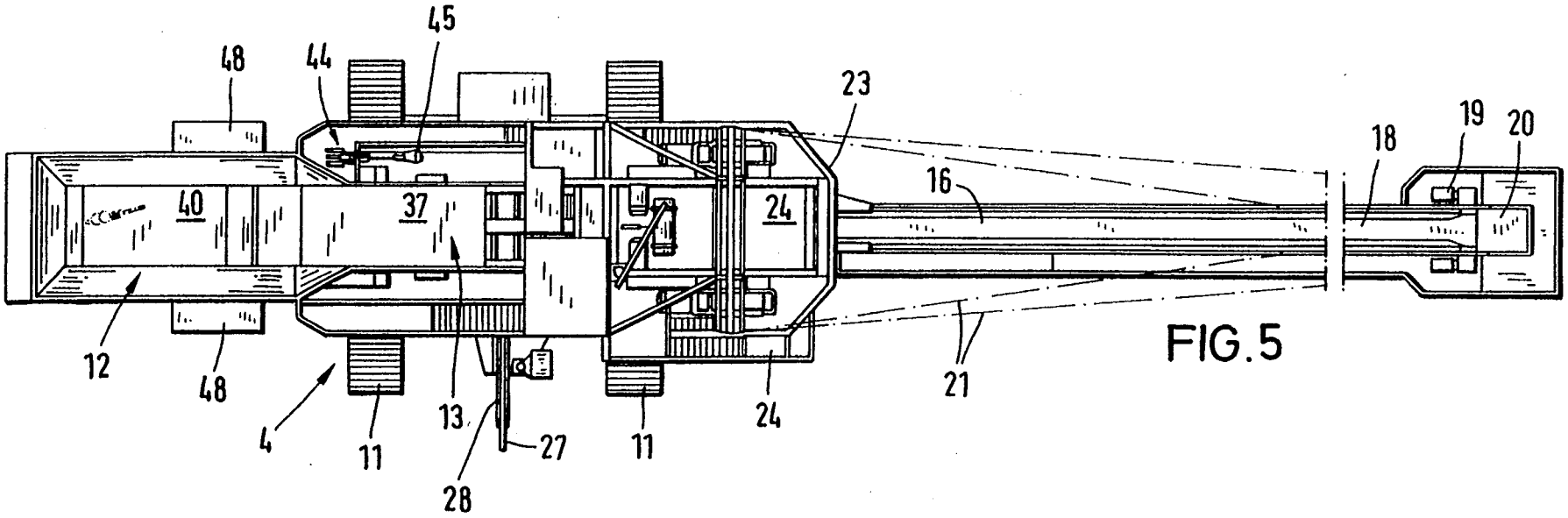
FIG. 5 is a more detailed plan view of the machine shown in FIGS. 1 to 4.

As shown in more detail in FIGS. 4 and 5, the machine 4 has a substructure or chassis 9 supporting the endless tracks 11 and associated drive gearing 10. The chassis 9 has opposed outrigger portions projecting outwardly from the tracks 11 and one of these outrigger portions supports the hopper 12. A conveyor 14, conveniently a scraper-chain conveyor, transfers the crude spoil material from the screen arrangement 13 supported by the chassis 9 to the jib 16 and operates in association with a crusher 15 which reduces the size of the lumps of spoil.

The jib 16 extends over a considerable distance and itself employs a conveyor 18 for transferring the spoil along the jib 16 for discharge onto a peak or crest 17' (FIG. 1) of the dump 17. The free end 19 of the jib 17 is equipped with a drive for the conveyor 18. The jib 16 is supported by a cable 21 which is anchored to a gantry 20 extending upwardly from the chassis outrigger portion opposite the hopper 12. The jib 16 adopts an inclined disposition and is mounted to the base of the gantry 20 with a pivot bearing 22. The cable 21 can be adjusted with a winch to raise or lower the jib 16 about the bearing 22.

The chassis 9 and its outrigger portion supporting the gantry 20 also has a upstanding frame 23 with a platform 24 on which is disposed a driver's cabin 25 and a housing 26 for the various drive controls and motors. The machine 4 can be powered by electricity supplied by a cable which follows the machine 4 and the cable can be entrained onto a reek 28 (FIG. 4) and wound onto or unwound therefrom.

On the chassis 9 beneath the screen arrangement 13 and the conveyor 14 there is a further conveyor means 29, which supplies the usable fine mineral ore product passed through the screen arrangement 13 directly onto the conveyor 8. The conveyor means 29 is adjustable in length. As illustrated the conveyor means 29 is composed of main conveyor 30, conveniently a scraper-chain conveyor adopting a horizontal disposition and fixed to the chassis 9. The conveyor 30 has a drive and discharge region 31 and a reversing region 32 and extends from just beyond the discharge of the screen arrangement 13 to near an outer side of the other outrigger portion of the chassis 9. A supplementary conveyor unit 33 (FIG. 3) such as another scraper-chain conveyor or a belt conveyor can be assembled to the end region 31 of the main conveyor 30 to extend the length of the conveyor means 29. The connection between the conveyors 30,33 employs a pivot joint 34. It is also desirable to suspend the additional conveyor unit 33 from the jib 16 via a cable 36.

FIGS. 2 and 3 show the conveyor means 29 in two working states with and without the supplementary conveyor unit 33 with a corresponding variable distance between the chassis 9 and the conveyor 8. When the conveyor unit 33 is not in use it can be detached and removed.

The screen arrangement 13 preferably has an oscillating drive with two superimposed inclined screens 37,38 which oscillate back and forth. The upper screen 37, which has a greater area and mesh size than the lower screen 38, can be simply composed of a open mesh or grid. A mechanism 39, which can take the form of a reciprocating feeder, transfers the raw ore material from the hopper 12 to the screen arrangement 13. The mechanism 39 as illustrated employs a plate-like pusher 40 operating at the base of the hopper 12 and mounted on support rollers 41 for reciprocal movement towards and away from the screen arrangement 13. The crude raw ore material is initially passed by the transfer mechanism 39 onto the upper screen 37. Coarse material unable to pass through the screen 37 is passed onto the conveyor 14. Finer material passing through the screen 37 falls onto the lower screen 38 which performs a second screening operation. Material unable to pass through the lower screen 38 is also passed onto the conveyor 14. The fine usable mineral ore product passing through the lower screen 38 is collected by the conveyor means 29 and transferred to the conveyor 8.

The crusher 15 co-operating with the conveyor 14 can take the form of an impact roll crusher with a rotatable crusher roll supported in a housing above the conveyor 14. The drive for the crusher 15 is designated by reference numeral 43. The crusher 15 serves to reduce larger pieces of debris and material broken down by the crusher 15 is discharged back onto the conveyor 14 for transfer to the jib 16.

If particularly large lumps or pieces of raw ore material, for example, pieces with sizes 1000–2000 mm are delivered to the hopper 12 these can be reduced by means of an appliance 44 arranged above the hopper 12 and the screen arrangement 13. This appliance 44 takes the form of an impact tool or hammer 45 carried by a lever system 46 operated by one or more hydraulic rams and adjustably mounted on a bearing 47. The tool 45 can be moved from place to place to break down the larger lumps of raw ore material on the screen 37 or in the hopper 12.

The chassis 9 is provided with hydraulically operated supports 48,49 which can be raised or lowered relative to the floor 7. The supports 48,49 can thus be lowered to lift the machine 4 and release the tracks 11 to brace the machine 4 during its operation. The supports 48,49 are composed of two supports 48 on the outrigger portion of the chassis 9 near the hopper 12 and disposed parallel to the side of the hopper 12 and one support 49 at the opposite side on the other outrigger portion of the chassis 9.

When the first band I shown in FIG. 1 is being worked, the conveyor unit 33 is removed and the machine 4 moves along behind the machine 6 in the direction of arrow 3. The conveyor 30 has it delivery end 31 above the conveyor 8 (see also FIGS. 2 and 4). The raw ore material excavated by the machine 6 is fed into the hopper 12 and is processed as described. Whilst the machine 4 is working to process a batch of delivered raw ore material it can be braced and fixed in position by extending the supports 48,49. Thus, as the machines 4,6, work together they move along the band I,II in the direction 3 over incremental stages.

Although some of the spoil discharged and spread by the jib 16 contains a small proportion of usable ore the majority of the usable ore is screened out and transferred as high grade ore to the conveyor 8.

When the band I has been fully extracted, the machines 4,6, move back in the reverse direction to arrow 3 and advance to the next band II in the direction 2 as depicted at the top of FIG. 1 and in FIG. 3. The supplementary conveyor unit 33 which has a length commensurate with the width of the bands I, I is now assembled to the conveyor 30 so that its discharge region 35 extends over the conveyor 8 which remains in position. The processor is now repeated and the jib 16 discharges the spoil along a new crest 17' as shown in FIG. 3. When the band II has been fully extracted the machines 4,6, are again moved back to start a fresh band and the conveyor 8 is moved up by a distance commensurate with twice the width of the ore extraction bands I,II. The conveyor unit 33 is now dismantled and removed and the process is carried out as before.

It is feasible to extend the conveyor means 29 still further with additional conveyor units so that, for example, the conveyor 8 need only be shifted after three bands have been excavated. It is also possible to extend the length of the jib 16 and this could be accomplished by adopting a telescopic construction for the jib 16.

We claim:

1. A mobile machine for processing mineral ore in-situ and for discharging spoil and finer mineral ore product separated after the processing; said machine comprising:

a chassis, means for supporting the chassis for movements along the ground predominantly in a rectilinear normal direction of travel;

first and second outrigger portions on the chassis extending laterally outwardly from the support means of the chassis and transversely to the normal direction of travel;

a hopper supported by the first outrigger portion for receiving raw mineral ore material excavated from an open cast working;

screening means supported by the chassis for receiving material from the hopper and for separating coarser spoil material from the finer mineral ore product;

a multi-component conveyor means which is adjustable or displaceable to vary its effective length for transferring the mineral ore product from the screening means and away from the second outrigger portion in a direction extending transversely to the normal direction of travel; and a crusher for reducing the size of the spoil material processed and discharged by the screening means, a jib extending transversely to the normal direction of travel and outwardly from the second outrigger portion in the same direction as the multi-component conveyor means and means for transferring the spoil from the screening means and the crusher to the jib and along the jib for elevated discharge.

2. A machine according to claim 1, wherein the conveyor means is composed of a conveyor extending transversely to the normal direction of motion of the machine and supported by the chassis and a further conveyor unit which can be assembled with or removed from said conveyor to vary the effective length of the conveyor means.

3. A machine according to claim 2, wherein the further conveyor unit is assembled to the conveyor with a pivot joint therebetween and means is provided for supporting the further conveyor unit by suspension.

4. A machine according to claim 1, wherein the jib is supported in an inclined disposition and ascends to a discharge zone at the free end and the conveying means delivers the ore product onto a further separate independent conveyor supported on the ground and extending parallel to the normal direction of motion of the machine.

5. A machine according to claim 4, wherein there is a gantry from which the jib is suspended in the inclined disposition.

6. A machine according to claim 1, wherein the screening means is composed of at least one oscillating screen.

7. A machine according to claim 1, wherein the screening means is composed of a pair of superimposed oscillating screens.

8. A machine according to claim 1, wherein the transfer means includes a conveyor supported by the chassis which serves to transfer the spoil material from the screening means to the jib.

9. A machine according to claim 8 wherein the conveyor means extends beneath the screening means and the conveyor of the transfer means.

10. A machine according to claim 8, wherein the conveyor of the transfer means is cooperatively associated with the crusher for reducing the size of the spoil material.

11. A machine according to claim 10, wherein the crusher employs an impact roll rotatably supported in a housing above the conveyor of the transfer means.

12. A machine according to claim 1, wherein the hopper and the screening means are disposed laterally adjacent one another relative to the normal direction of motion of the machine and a transfer mechanism serves to transfer the raw ore material from the hopper to the screening means.

13. A machine according to claim 12, wherein the transfer mechanism employs a reciprocatable plate-like pusher.

14. A machine according to claim 1, wherein the support means is composed of endless tracks.

15. A machine according to claim 14, wherein the screening means is supported by the chassis between the hopper and the jib.

16. A machine according to claim 15, wherein a breaking appliance is mounted generally above the screening means and the hopper and serves to reduce the size of the material processed by the screening means.

17. A machine according to claim 16, wherein the breaking appliance employs a positionally adjustable impact tool.

18. A machine according to claim 15, wherein the chassis is provided with raisable and lowerable supports which can brace the machine and partially relieve the tracks.

19. A machine according to claim 18, wherein there are three supports, two of the supports being disposed at or near the hopper on the first outrigger portion and a third support disposed on the second outrigger portion.

20. A machine according to claim 1, wherein the conveyor means or a component part of the conveyor means is composed of a scraper-chain conveyor.

* * * * *